US008312820B2

(12) United States Patent
Rotlevi et al.

(10) Patent No.: US 8,312,820 B2
(45) Date of Patent: Nov. 20, 2012

(54) MOUNT FOR USE WITH A DESK OR WORK STATION

(75) Inventors: Amir Rotlevi, Kew Gardens, NY (US); Vinci George Mathews, Queens Village, NY (US)

(73) Assignee: A.F.C. Industries, Inc., College Point, NY (US)

( * ) Notice: Subject to any disclaimer, the term of this patent is extended or adjusted under 35 U.S.C. 154(b) by 284 days.

(21) Appl. No.: 12/686,371

(22) Filed: Jan. 12, 2010

(65) Prior Publication Data

US 2011/0168063 A1 Jul. 14, 2011

(51) Int. Cl.
*A47B 37/00* (2006.01)

(52) U.S. Cl. ..... 108/50.01; 108/7

(58) Field of Classification Search ..... 108/1, 7, 108/5, 8, 9, 10, 50.01, 50.02, 147, 145, 147.11, 108/143, 141; 312/195, 223.3, 223.6, 223.1; 248/371, 372.1

See application file for complete search history.

(56) References Cited

U.S. PATENT DOCUMENTS

| | | | | | |
|---|---|---|---|---|---|
| 1,652,774 | A * | 12/1927 | Fraser et al. | ..... | 108/8 |
| 1,872,849 | A * | 8/1932 | Townes | ..... | 108/8 |
| 3,183,860 | A * | 5/1965 | Kritske | ..... | 108/8 |
| 3,605,650 | A * | 9/1971 | Hebel et al. | ..... | 108/9 |
| 4,047,774 | A * | 9/1977 | Hanning | ..... | 108/8 |
| 4,736,689 | A * | 4/1988 | Stanko | ..... | 108/143 |
| 5,450,800 | A * | 9/1995 | Leonard | ..... | 108/7 |
| 5,598,789 | A * | 2/1997 | Jonker | ..... | 108/147 |
| 5,626,323 | A * | 5/1997 | Lechman et al. | ..... | 108/137 |
| 6,038,986 | A * | 3/2000 | Ransil et al. | ..... | 108/145 |
| 6,216,606 | B1 * | 4/2001 | Kathardekar et al. | ..... | 108/50.02 |
| 6,553,919 | B1 | 4/2003 | Nevin | ..... | 108/50.01 |
| 6,691,626 | B2 * | 2/2004 | Warner | ..... | 108/145 |
| D510,821 | S | 10/2005 | Madison | ..... | D6/425 |
| D521,770 | S | 5/2006 | Madison | ..... | D6/425 |
| 7,047,890 | B2 * | 5/2006 | Korber et al. | ..... | 108/50.01 |
| 7,140,306 | B2 * | 11/2006 | Chen | ..... | 108/138 |
| 2006/0185564 | A1 * | 8/2006 | Stengel et al. | ..... | 108/50.01 |

* cited by examiner

*Primary Examiner* — Jose V Chen
(74) *Attorney, Agent, or Firm* — Ido Tuchman

(57) ABSTRACT

A mount for carrying a display and like devices. The mount includes a base and a support pivotally coupled to the base. The support includes a mounting surface to carry at least one device. At least one rail constrains movement of the base along a horizontal plane. A pivot actuator is configured to pivot the support between a vertical position and a horizontal position. The mounting surface is substantially orthogonal to the horizontal plane in the vertical position. In the horizontal position, the mounting surface is substantially parallel to the horizontal plane.

19 Claims, 5 Drawing Sheets

MOUNT FOR USE WITH A DESK OR WORK STATION

BACKGROUND

The present invention relates to a mount for use with a desk or work station.

The proliferation of inexpensive flat screen displays has helped popularize large size monitors and multiple monitors used on work desks. Furthermore, recent advances multi-touch computers, such as Microsoft Surface, can take advantage of large size monitors and provide a more intuitive user interface.

Unfortunately, a large monitor can reduce the amount of usable desk surface. Wall mounts, configured to secure displays to walls, can free desk space. However, such wall mounts require a wall in close proximity to the desk. A wall mounted display may be located too far from the user.

Some wall mounts and desk mounts are configured to articulate and allow for better positioning of the display with respect to the user. However, articulating mounts often have weight limits that present large size monitors from being used. Furthermore, articulating mounts can move when used with a touch screen display.

SUMMARY

The present invention includes a display mount for use in a desk or table that can tilt one or more displays or other instrument from a flat position to an upright position. The mount may also allow adjustment of the proximity of the display to the user by sliding the display back and forth when the display is in the upright position. The height of the display and desk surface may also be adjustable.

Thus, one example of the invention is a mount including a base and a support pivotally coupled to the base. The support includes a mounting surface to carry at least one device. At least one rail constrains movement of the base along a horizontal plane. A pivot actuator is configured to pivot the support between a vertical position and a horizontal position. In the vertical position, the mounting surface is substantially orthogonal to the horizontal plane. In the horizontal position, the mounting surface is substantially parallel to the horizontal plane.

Another example of the invention is a display mount. The display mount includes a first base member with a first actuator platform, a second base member, and a base cross member coupling the first base member and the second base member. A first rail receives a first set of bearings and constrains movement of the first base member along a horizontal plane. A second rail receives a second set of bearings and constrains movement of the second base member along the horizontal plane. A first support member is pivotally coupled to the first base member and defines a first slot. A second support member is pivotally coupled to the second base member and defines a second slot. A support cross member couples the first support member and the second support member. The support cross member includes a display mounting surface configured to carry at least one display.

A first cam member is pivotally coupled to the first base member. The first cam member includes a first rod engaging the first slot. As the first cam member pivots about the first base member, the first rod travels along the first slot and pivots the first support member. Likewise, a second cam member is pivotally coupled to the second base member. The second cam member includes a second rod engaging the second slot. As the second cam member pivots about the second base member, the second rod travels along the second slot and pivots the second support member. A cam cross member couples the first cam member and the second cam member.

A first pivot actuator is mounted to the first actuator platform and is coupled to the cam cross member. The first pivot actuator is configured to pivot the cam cross member between a vertical position and a horizontal position. In the vertical position, the display mounting surface is orthogonal to the horizontal plane. In the horizontal position, the display mounting surface is parallel to the horizontal plane.

The display mount may include a second pivot actuator coupled to the second cam member and configured to pivot the second cam member between the vertical position and the horizontal position. The display mount may optionally include horizontal actuator configured to move the second base section along the horizontal plane.

Yet a further example of the invention is a work station. The work station includes a desk frame, a desk surface carried by the desk frame, and a display mount coupled to the desk frame. The display mount is configured to move a display mounted to the display mount along a plane parallel to the desk surface between a front position and back position. The display mount is further configured to pivot a display surface of the display about an axis parallel to the desk surface between a vertical position orthogonal to the desk surface and a horizontal position parallel to the desk surface.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DETAILED DESCRIPTION

Figure 1:
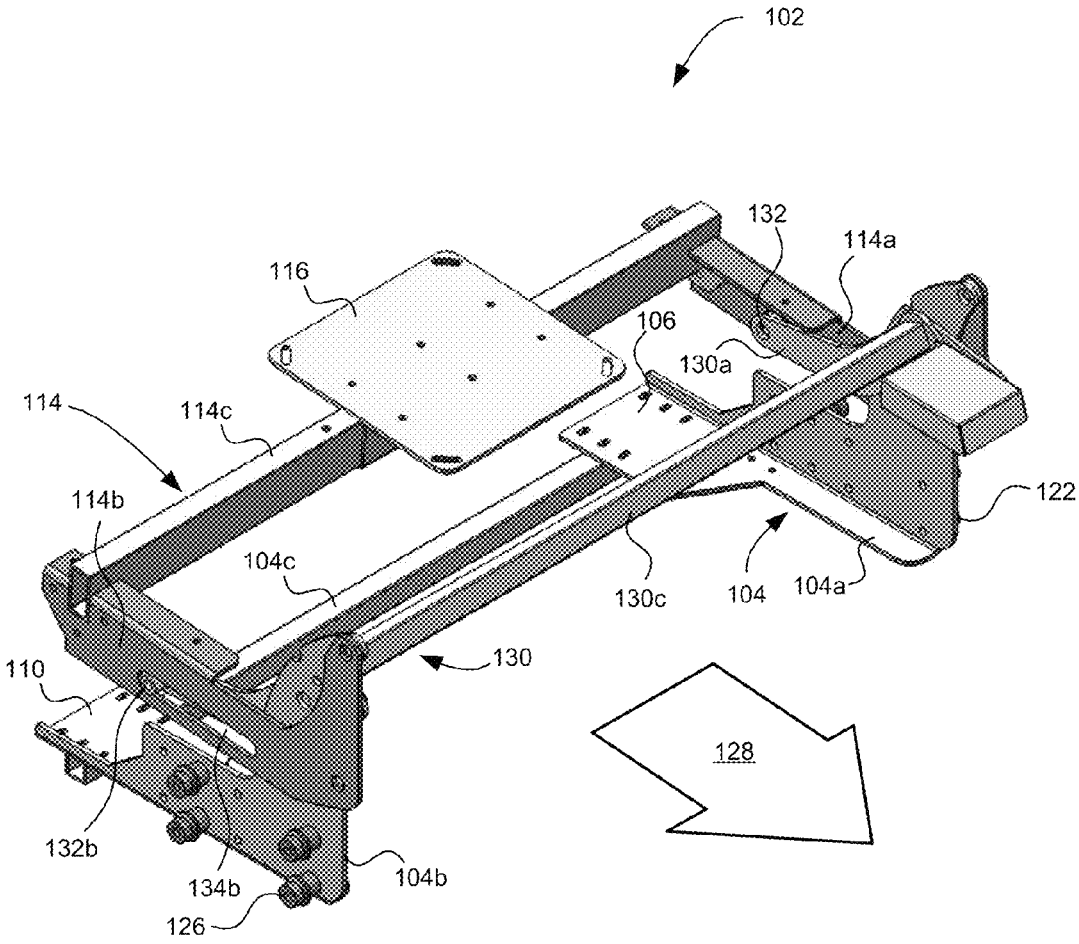
FIG. 1 shows an example display mount assembly contemplated by the present invention in a vertical position.

The invention will now be described more fully hereinafter with reference to the accompanying FIGS. 1-4, in which example embodiments of the invention are shown. The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising,"

when used in this specification and claims, specify the presence of stated features, integers, steps, operations, elements, and/or components, but do not preclude the presence or addition of one or more other features, integers, steps, operations, elements, components, and/or groups thereof. In the following description, reference is made to the accompanying drawings where like reference numerals refer to like parts throughout the disclosure, like numbers with letter suffixes are used to identify similar parts in a single embodiment.

As will be described in detail below, one embodiment of the present invention is a display mount coupled to the desk frame. The display mount includes a display mounting surface that is free to move both linearly and pivotally with respect to a desk surface. Specifically, the display mounting surface moves along a plane parallel to the desk surface between a front position and back position. Additionally, the display mounting surface pivots about an axis parallel to the desk surface such that the display may be tilted between a vertical position orthogonal to the desk surface and a horizontal position parallel to the desk surface.

Turning now to FIG. 1, an embodiment of a mount 102 contemplated by the present invention is shown. The mount 102 includes a base 104. The base 104 may include a first base member 104*a*, a second base member 104*b*, and a base cross member 104*c*. The base cross member coupling the first base member and the second base member.

As will be discussed in more detail below, the base 104 may include a mounting point for movement actuators. For example, the first base member 104*a* may include a first actuator platform 106 for mounting a first pivot actuator 108 (see FIG. 2). The second base member 104*b* may include a second actuator platform 110 for mounting a second pivot actuator 112 (see FIG. 2).

The base 104 is constrained to move along a horizontal plane 128 by at least one rail. For example, a first rail 120 (see FIG. 2) receives a first set of bearings 122 and constrains movement of the first base member 104*a* along the horizontal plane 128. A second rail 124 (see FIG. 2) receives a second set of bearings 126 and constrains movement of the second base member 104*b* along the horizontal plane 128.

The mount 102 also includes a support assembly 114 pivotally coupled to the base 104. In one embodiment, the support assembly 114 includes at least one mounting surface 116 to carry at least one device. As mentioned above, such a device may be a flat screen display. It is contemplated that other devices may be carried by the mounting surface 116, such as, but not limited to, control panels, communication devices, and laboratory equipment.

The support assembly 114 may include a first support member 114*a* pivotally coupled to the first base member 104*a*, a second support member 114*b* pivotally coupled to the second base member 104*b*, and a support cross member 114*c* coupling the first support member 114*a* and the second support member 114*b*.

Figure 5:
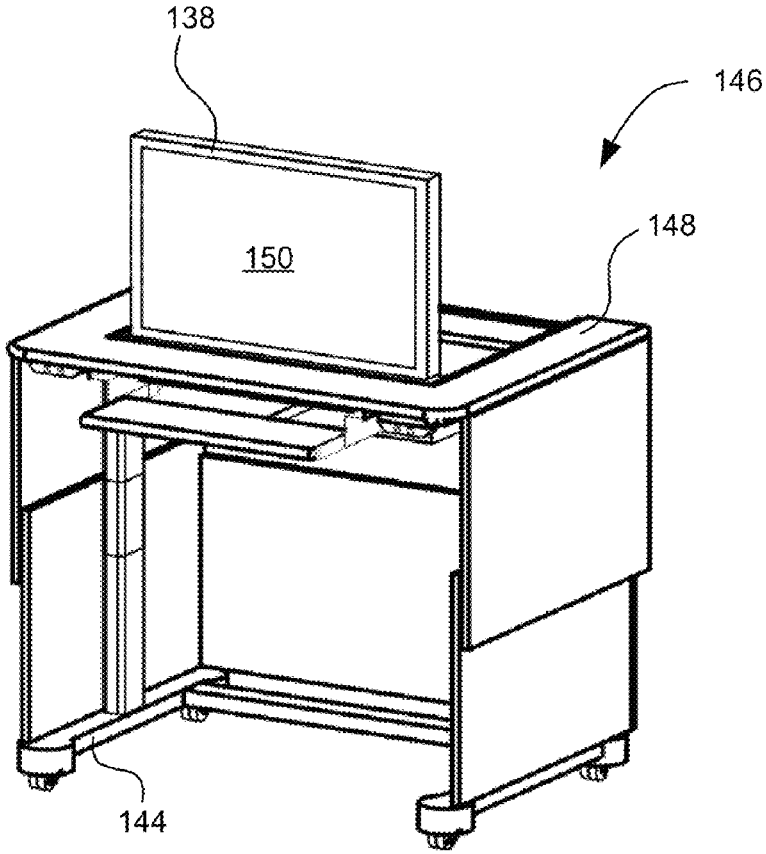
FIG. 5 shows an example work station contemplated by the present invention, with a display support in the vertical and front position.
Figure 6:
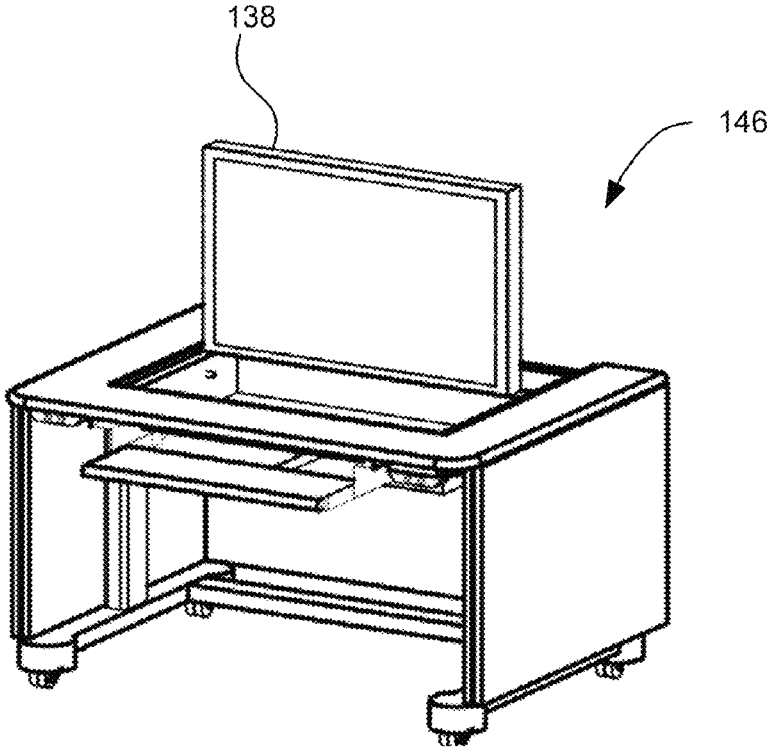
FIG. 6 shows an example work station contemplated by the present invention, with a display support in the vertical and back position, and frame members in an extended.
Figure 7:
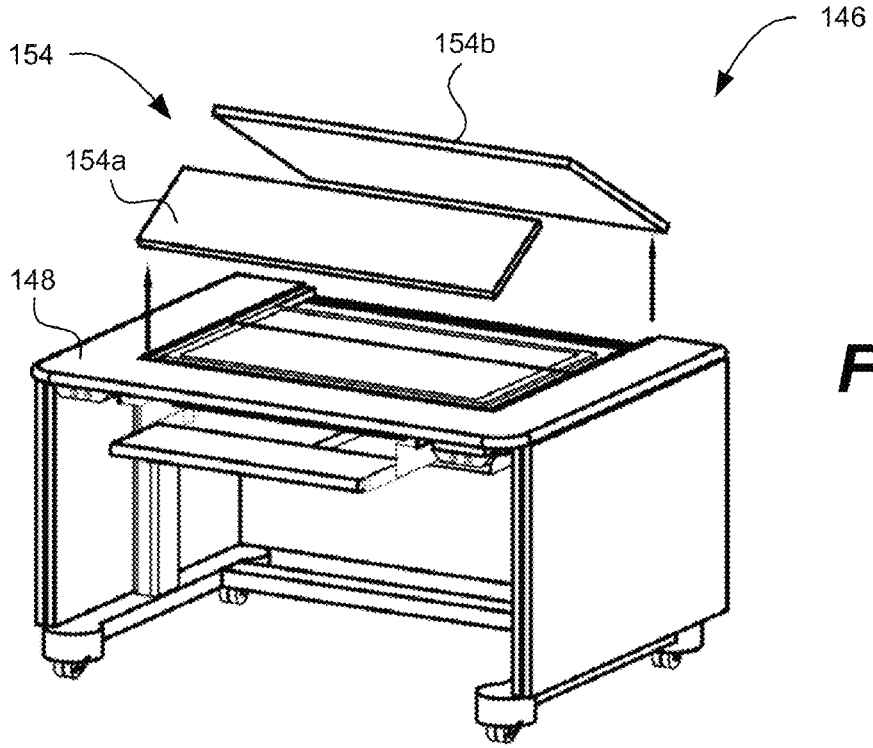
FIG. 7 shows an example work station contemplated by the present invention, with a display support in the horizontal and front position, and frame members in a collapsed position.
Figure 8:
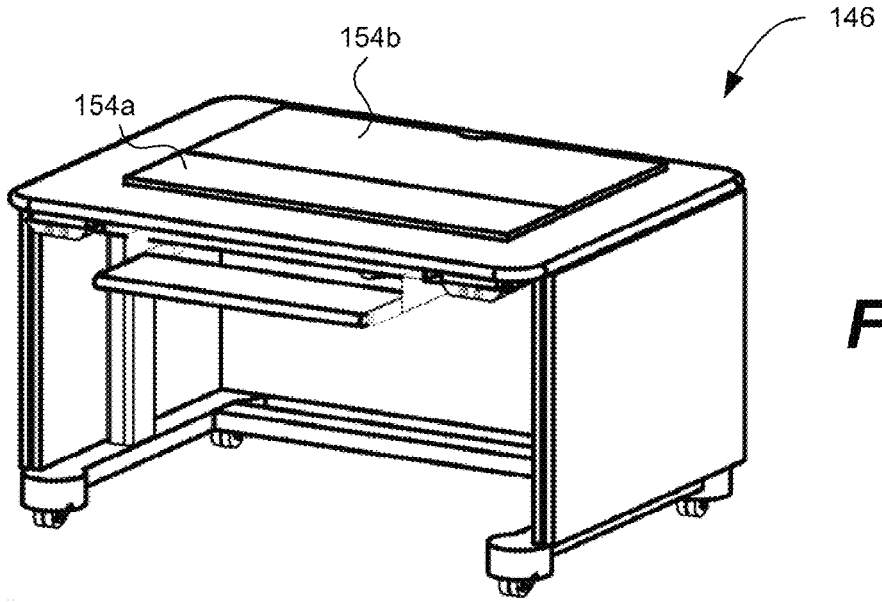
FIG. 8 shows an example work station contemplated by the present invention, with display covers over a display.

The first pivot actuator 108 is configured to pivot the support assembly 114 between a vertical position (shown in FIGS. 5 and 6) and a horizontal position (shown in FIGS. 7 and 8). More particularly, in the vertical position, the mounting surface 116 is substantially orthogonal to the horizontal plane 128. In the horizontal position, the mounting surface 116 is substantially parallel to the horizontal plane 128.

In a particular embodiment of the invention, the display mount 102 includes a cam assembly 130 pivotally coupled to the base 104 and the first pivot actuator 108. The cam assembly 130 includes at least one rod 132 received by at least one slot 134 in the support assembly 114. As the first pivot actuator 108 pushes and pulls the cam assembly 130, the rod 132 slides along the length of the slot 134 and urges the support assembly 114 to pivot about the base 104. Thus, the slot 134 can act as both a guide and end stop for the cam assembly 130 travel.

In an example configuration, the cam assembly 130 includes a first cam member 130*a*, a second cam member 103*b*, and a cam cross member 130*c* coupling the first cam member 130*a* and the second cam member 130*b*. The first cam member 130*a* is pivotally mounted to the first base member 104*a*, and the second cam member 130*b* is pivotally mounted to the second base member 104*b*.

A first rod 132*a* attached to the first cam member 130*a* engages a first slot 134*a* defined by the first support member 114*a*. For added stability, a second rod 132*b* at the second cam member 130*b* may engage a second slot 134*b* defined by the second support member 114*b*.

The first pivot actuator 108 may be coupled to the cam assembly 130 at a proximate end of the cam cross member 130*c*. As the first pivot actuator 108 draws the cam cross member 130*c* closer, the rods 132*a* and 132*b* travel upwardly along the slots 134*a* and 134*b*, causing the support assembly 114 to pivot to the vertical position. As the first pivot actuator 108 pushes the cam cross member 130*c* away, the rods 132*a* and 132*b* travel downwardly along the slots 134*a* and 134*b*, causing the support assembly 114 to pivot to the horizontal position.

As mentioned above, the mount 102 may optionally include a second pivot actuator 112 for added force in moving heavier loads and increased system stability. The second pivot actuator 112 is mounted to the second mounting platform 110 and coupled to a distal end of the cam cross member 103*c*. In one embodiment of the invention, the actuators include a brushless motor 111 coupled to a threaded lead screw. Such actuators translate the radial motion of the motor into linear motion. Limit switches prevent the actuator from traveling beyond its intended range of motion.

Figure 2:
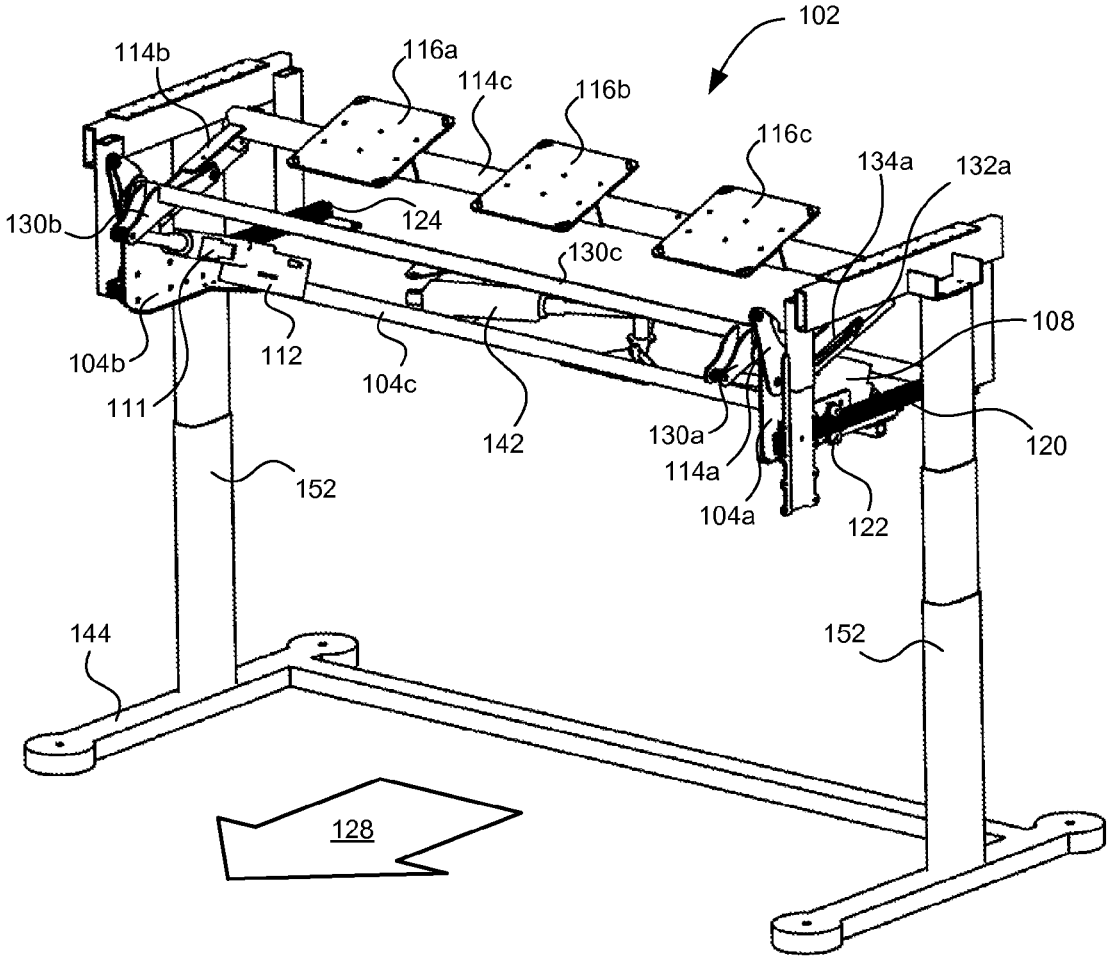
FIG. 2 shows an example display mount assembly contemplated by the present invention, including pivot actuators and a horizontal actuator.

FIG. 2 shows another embodiment of a mount 102 contemplated by the present invention is shown. The mount 102 includes a plurality of display mounting surfaces 116*a*, 116*b*, 116*c* configured to secure a plurality of displays or other devices. As discussed above, the mount 102 allows movement of the displays linearly along a horizontal axis, as well as about a radial axis on the base 104.

More specifically, the displays can be positioned between a front position and a back position. In a particular configuration of the invention, a first rail 120 receives a first set of bearings 122 and a second rail 124 receives a second set of bearings 126. The first rail 120 and the second rail 124 constrain movement of the base 104 along a horizontal plane 128.

As shown in FIG. 2, a horizontal actuator 142 is configured to move the base 104 along the horizontal plane 128. The horizontal actuator 142 may be similar to the first pivot actuator 108 discussed above. In one embodiment, the second base member 104*b* includes a second mounting platform 110. The horizontal actuator 142 is mounted to the base cross member 104*c* at one end, and is coupled to a desk frame 144 at another end. As the horizontal actuator 142 moves its lead screw in and out, the base 104 moves along the horizontal plane 128.

The pivot actuators 108, 112 move the displays about a radial axis on the base 104. Specifically, the first pivot actuator 108 is mounted to a first mounting platform 106 on the first base member 104*a* and the second pivot actuator 112 is mounted to a second mounting platform 110 on the second base member 104*b*. The pivot actuators 108, 112 are also coupled to the cam cross member 130*c* and are configured to pivot the cam cross member 130*c* between a vertical position and a horizontal position. In the vertical position, the display mounting surface(s) 116 is (are) orthogonal to the horizontal plane 128. In the horizontal position, the display mounting surface(s) 116 is (are) parallel to the horizontal plane 128.

As shown in FIG. 2, the display mount 102 may be carried by the desk frame 144. The desk frame 144 may include a plurality of telescoping frame members 152 configured to travel vertically between a collapsed position and an extended position.

Figure 3:
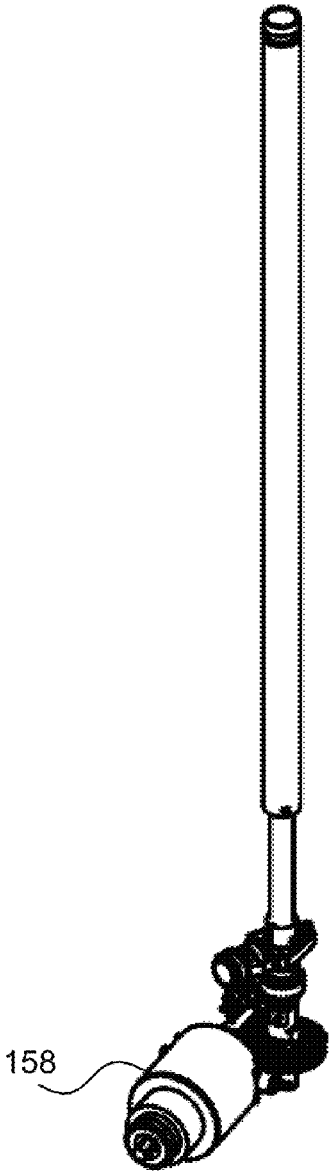
FIG. 3 shows an example vertical actuator within telescoping frame members.
Figure 4:
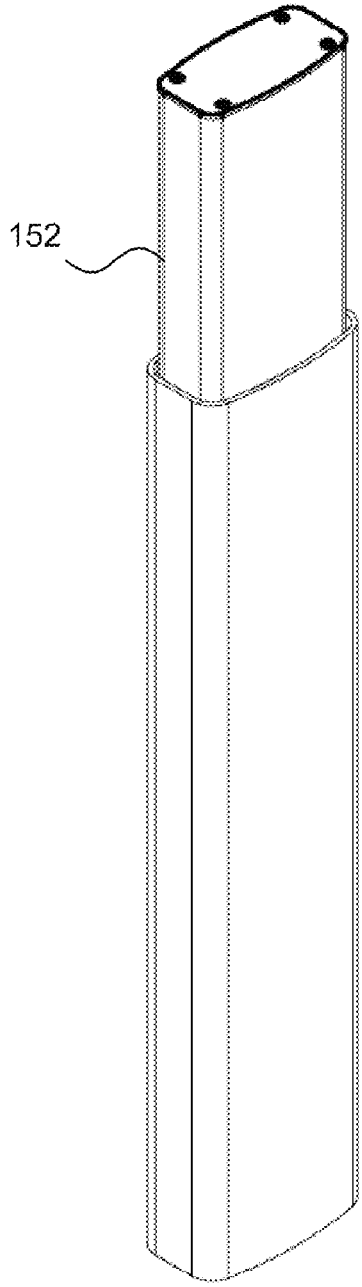
FIG. 4 shows an example telescoping frame members contemplated by the present invention, with a display.

As shown in FIGS. 3 and 4, the telescoping frame members 152 include a height actuator 158. The telescoping frame members 152 allow adjustment of a desk surface and the display mount 102 height by rising and lowering. This way, the user can switch from a sitting position to a standing position. For example, at or near the collapsed position (shown in FIG. 6) the desk surface height may be most suitable for use while the user is sitting. At or near the extended position (shown in FIG. 5) the desk surface height may be most suitable for use while the user is standing.

The display mount 102 may include a base 104 carried by the desk frame 144. A display support 114, configured to carry the display 138, is pivotally coupled to the base 104. The display mount 102 may also include at least one rail 120 constraining movement of the base 104 along the plane parallel to the desk surface 150. The display mount 102 may also include a pivot actuator 108 configured to pivot the display support 114 between the vertical position and the horizontal position.

Returning to FIG. 2, in one embodiment of the invention, the display mount 102 can manually slide between a front position (see FIG. 5) and the back position (see FIG. 6). In another embodiment of the invention, the display mount 102 may include a horizontal actuator 142 coupled to the base 104 and the desk frame 144. The horizontal actuator 142 is configured to move the base 104 along the plane parallel to the desk surface.

FIGS. 5-8 show an example work station 146 contemplated by the present invention. The work station 146 includes a desk frame 144 and a desk surface 148 carried by the desk frame. A display mount 102, as described above, is coupled to the desk frame 144.

As discussed above, the display mount 102 is configured to move a display 138 along a plane parallel to the desk surface 148 between a front position (FIG. 5) and a back position (FIG. 6). The display mount is further configured to pivot a display surface 150 of the display 138 about an axis parallel to the desk surface 148 between a vertical position orthogonal to the desk surface 148 and a horizontal position parallel to the desk surface 148.

The desk surface 148 may be substantially U-shaped. The U-shaped desk surface allows the display 138 to be stored substantially flush with or below the desk surface 148 when the support assembly 114 is the horizontal position. As the display 138 is moved to the vertical position, it crosses the desk surface plane through an aperture defined by the U-shaped desk surface. Thus, the desk surface 148 defines a display opening through which the display mount 102 is configured to pivot the display 148 between the vertical position and the horizontal position.

It is emphasized that although FIGS. 5-8 illustrate a single display 138 secured to the mounting surface 116, other embodiments of the invention are not limited to such. For example, the mount 102 may be used to secure multiple displays and/or audio equipment, such a mixers and equalizers, to the mounting surface 116.

The work station 146 may further include one or more removable display covers 154 to at least partially cover the display opening of the desk surface 148. The display cover 154 is configured to be substantially flush with the desk surface 148 when placed over the display opening. To support the display cover 154, a small lip or platform may be fabricated along the interior edge of the desk surface 148 defining the display opening. The display cover 154 can be made, for example, from wood or a rigid thermoplastic. When in use, the display cover 154 can increase the desk surface area while the display 138 is in the horizontal position or is in the back position.

For example, as shown in FIGS. 6 and 7, a first display cover 154*a* can be placed over the display opening between the display 138 when the display 138 is in the vertical and back position. The first display cover 154*a* and a second display cover 154*b* can be placed over the display opening when the display 138 is in the horizontal position. The first display cover 154*a* and a second display cover 154*b* can be used to cover the entire display opening, thereby maximizing the usable desk space.

While the preferred embodiments to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A mount comprising:

a base;

a support pivotally coupled to the base, the support including a mounting surface to carry at least one device;

at least one rail constraining movement of the base along a horizontal plane; and a pivot actuator configured to pivot the support between a vertical position and a horizontal position;

a horizontal actuator configured to move the base along the horizontal plane; and a plurality of bearings;

wherein the rail receives the bearings; and wherein the mounting surface is substantially orthogonal to the horizontal plane in the vertical position and the mounting surface is substantially parallel to the horizontal plane in the horizontal position.

2. The mount of claim 1, wherein the base comprises:

a first base member including a first actuator platform, the pivot actuator being mounted to the first actuator platform;

a second base member; and a base cross member coupling the first base member and the second base member.

3. The mount of claim 2, further comprising:

a second pivot actuator to pivot the support between a vertical position and a horizontal position; and wherein the second base member includes a second actuator platform, the second pivot actuator being mounted to the second actuator platform.

4. The mount of claim 1, wherein the support comprises:

a first support member pivotally coupled to the base;

a second support member pivotally coupled to the base; and a support cross member coupling the first support member and the second support member.

5. The mount of claim 1, further comprising:

a cam pivotally coupled to the base and the pivot actuator, the cam including at least one rod received by at least one slot in the support; and wherein as the cam pivots about the base, the rod travels along the slot and pivots the support.

6. The mount of claim 5, wherein the cam comprises:

a first cam member pivotally coupled to the base;

a first rod coupled to the first cam member and engaging a first slot in the support;

a second cam member pivotally coupled to the base;

a second rod coupled to the second cam member and engaging a second slot in the support; and a cam cross member coupling the first cam member and the second cam member.

7. The mount of claim 1, wherein the pivot actuator includes a motor.

8. A display mount comprising:

a first base member including a first actuator platform;

a second base member; and a base cross member coupling the first base member and the second base member;

a first rail receiving a first set of bearings and constraining movement of the first base member along a horizontal plane;

a second rail receiving a second set of bearings and constraining movement of the second base member along the horizontal plane;

a first support member pivotally coupled to the first base member and defining a first slot;

a second support member pivotally coupled to the second base member and defining a second slot; and a support cross member coupling the first support member and the second support member, the support cross member including a display mounting surface configured to carry at least one display;

a first cam member pivotally coupled to the first base member, the first cam member including a first rod engaging the first slot, wherein as the first cam member pivots about the first base member, the first rod travels along the first slot and pivots the first support member;

a second cam member pivotally coupled to the second base member, the second cam member including a second rod engaging the second slot, wherein as the second cam member pivots about the second base member, the second rod travels along the second slot and pivots the second support member;

a cam cross member coupling the first cam member and the second cam member; and a first pivot actuator mounted to the first actuator platform and coupled to the cam cross member, the first pivot actuator configured to pivot the cam cross member between a vertical position and a horizontal position; and wherein the display mounting surface is orthogonal to the horizontal plane in the vertical position and the display mounting surface is parallel to the horizontal plane in the horizontal position.

9. The display mount of claim 8, further comprising:

a horizontal actuator coupled to the base cross member along and configured to move the base cross member along the horizontal plane.

10. The display mount of claim 8, further comprising:

a second pivot actuator coupled to the second cam member and configured to pivot the second cam member between the vertical position and the horizontal position; and wherein the second base member includes a second actuator platform, the second pivot actuator being mounted to the second actuator platform.

11. A work station comprising:

a desk frame;

a desk surface carried by the desk frame, the desk surface including a front of the desk surface and a rear of the desk surface; and a display mount coupled to the desk frame, the display mount is configured to move a display mounted to the display mount along a plane parallel to the desk surface between a front position proximate the front of the desk surface and back position proximate the rear of the desk surface, the display mount is further configured to pivot a display surface of the display about an axis parallel to the desk surface between a vertical position orthogonal to the desk surface and a horizontal position parallel to the desk surface.

12. The work station of claim 11, wherein the display mount comprises:

a base carried by the desk frame;

a display support pivotally coupled to the base, the display support configured to carry the display;

at least one rail constraining movement of the base along the plane parallel to the desk surface; and a pivot actuator configured to pivot the display support between the vertical position and the horizontal position.

13. The work station of claim 12, further comprising a horizontal actuator coupled to the base and the desk frame, the horizontal actuator configured to move the base along the plane parallel to the desk surface.

14. The work station of claim 11, wherein the display mount comprises:

a first base member carried by the desk frame, the first base member including a first actuator platform;

a second base member carried by the desk frame; and a base cross member coupling the first base member and the second base member;

a first rail receiving a first set of bearings and constraining movement of the first base member along the plane parallel to the desk surface;

a second rail receiving a second set of bearings and constraining movement of the second base member along the plane parallel to the desk surface;

a first support member pivotally coupled to the first base member and defining a first slot;

a second support member pivotally coupled to the second base member and defining a second slot; and a support cross member coupling the first support member and the second support member and configured to carry the display;

a first cam member pivotally coupled to the first base member, the first cam member including a first rod engaging the first slot, wherein as the first cam member pivots about the first base member, the first rod travels along the first slot and pivots the first support member;

a second cam member pivotally coupled to the second base member, the second cam member including a second rod engaging the second slot, wherein as the second cam member pivots about the second base member, the second rod travels along the second slot and pivots the second support member;

a cam cross member coupling the first cam member and the second cam member; and a first pivot actuator mounted to the first actuator platform and coupled to the cam cross member, the first pivot actuator configured to pivot the cam cross member.

15. The work station of claim 11, wherein the desk surface is substantially U-shaped.

16. The work station of claim 11, wherein the desk surface defines a display opening through which the display mount is configured to pivot the display between the vertical position and the horizontal position.

17. The work station of claim 16, further comprising a removable display cover configured to at least partially cover the display opening and be substantially flush with the desk surface when placed over the display opening.

18. The work station of claim 11, wherein the desk frame includes a plurality of telescoping frame members configured to travel vertically between a collapsed position and an extended position such that a height of the desk surface is adjustable.

19. The work station of claim 11, further comprising a motor to pivot the display surface.

* * * * *